US009139394B2

(12) United States Patent
Takei

(10) Patent No.: US 9,139,394 B2
(45) Date of Patent: Sep. 22, 2015

(54) ROLL-LIKE MEDIUM FEEDING APPARATUS AND RECORDING APPARATUS

(75) Inventor: Hiroaki Takei, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 503 days.

(21) Appl. No.: 13/212,120

(22) Filed: Aug. 17, 2011

(65) Prior Publication Data

US 2012/0043409 A1 Feb. 23, 2012

(30) Foreign Application Priority Data

Aug. 20, 2010 (JP) ..... 2010-184757

(51) Int. Cl.
*B65H 20/00* (2006.01)
*B65H 19/12* (2006.01)
*B65H 16/06* (2006.01)

(52) U.S. Cl.
CPC ..... *B65H 19/126* (2013.01); *B65H 2403/42* (2013.01); *B65H 2403/942* (2013.01); *B65H 2405/43* (2013.01)

(58) Field of Classification Search
USPC ..... 242/546, 564, 564.4, 598, 598.3, 598.4, 242/598.5, 599.1, 599.3, 611, 611.1
See application file for complete search history.

(56) References Cited

U.S. PATENT DOCUMENTS 3,894,617 A * 7/1975 Wiecko et al. ..... 188/75
3,934,835 A * 1/1976 Maxwell ..... 242/535.5
5,222,724 A * 6/1993 Hirano et al. ..... 271/10.11
5,419,543 A * 5/1995 Nakamura et al. ..... 271/9.01
5,782,468 A * 7/1998 Wu et al. ..... 271/10.05
6,082,912 A * 7/2000 Shimizu et al. ..... 400/120.01
6,257,569 B1 * 7/2001 Rhodes et al. ..... 271/117
6,749,298 B1 * 6/2004 Schalk et al. ..... 347/104
7,451,975 B2 * 11/2008 Cook et al. ..... 271/117
7,896,343 B2 * 3/2011 Iwago et al. ..... 271/301
8,177,219 B2 * 5/2012 Chen et al. ..... 271/114
8,308,100 B2 * 11/2012 Yanagishita ..... 242/390.6
2005/0206067 A1 9/2005 Cook et al.
2006/0216097 A1 * 9/2006 Ono ..... 400/225
2008/0011805 A1 * 1/2008 Genta et al. ..... 226/51

FOREIGN PATENT DOCUMENTS

JP 01-070557 5/1989
JP 2003-341889 12/2003
JP 2004-291395 10/2004
JP 2006-056032 3/2006

* cited by examiner

*Primary Examiner* — Emmanuel M Marcelo
*Assistant Examiner* — Justin Stefanon
(74) *Attorney, Agent, or Firm* — Workman Nydegger

(57) ABSTRACT

A roll-like medium feeding apparatus includes a support shaft supporting a roll-like medium to be mounted in a freely attached and detached manner, and includes a mounting portion to which a first shaft becoming the support shaft is mounted with the movement of a direction perpendicular to the first shaft in a freely attached and detached manner; a second gear wheel that can be meshed with a first gear wheel disposed in the first shaft and can be rotated around a second shaft which is disposed so as to be parallel to the first shaft that is in the state of being mounted to the mounting portion; and a displacement mechanism that is operated so as to displace the second gear wheel between a meshed position to be meshed with the first gear wheel that is in the state in which the first shaft is mounted to the mounting portion and a separated position separated from the first gear wheel.

6 Claims, 6 Drawing Sheets

ROLL-LIKE MEDIUM FEEDING APPARATUS AND RECORDING APPARATUS

The entire disclosure of Japanese Patent Application No: 2010-184757, filed Aug. 20, 2010 is expressly incorporated by reference herein in its entirety.

BACKGROUND

1. Technical Field

The present invention relates to, for example, a recording apparatus such as an ink jet type printer, and a roll-like medium feeding apparatus provided on the recording apparatus.

2. Related Art

Generally, as a recording apparatus which unwinds papers from a roll paper (a roll-like medium) in which long papers are wound in a roll shape to perform the recording processing, an ink jet type printer is widely known (for example, JP-A-2004-291395).

In the printer described in JP-A-2004-291395, a paper feeding apparatus is provided which mounts a roll paper holder shaft, around which the long papers are wound in a roll shape and are supported, in a freely attached and detached manner. Furthermore, in the paper feeding apparatus, a driving force transmission gear is provided which can be meshed with gears provided in both end portions of the roll paper holder shaft. Moreover, in the printer, in a case where the roll paper holder shaft is mounted to the paper feeding apparatus, the gear of the roller paper holder shaft is meshed with the driving force transmission gear of the paper feeding apparatus.

Incidentally, in the printer mentioned above, the gear of the roll paper holder shaft is meshed with the driving force transmission gear of the paper feeding apparatus or the meshed state is released while moving the roll paper holder shaft in the attachment and detachment direction relative to the paper feeding apparatus. For that reason, there is a concern that, upon attaching or detaching the roll paper holder shaft to or from the paper feeding apparatus, the gear of the roll paper holder shaft or the driving force transmission gear of the paper feeding apparatus will be damaged.

SUMMARY

An advantage of some aspects of the invention is to provide a roll-like medium feeding apparatus and a recording apparatus that are capable of executing the attachment and detachment operation of the roll-like medium while suppressing damage to components.

According to an aspect of the invention, there is provided a roll-like medium feeding apparatus in which a support shaft supporting the roll-like medium with a long medium wound in a roll shape is mounted in a freely attached and detached manner, and which unwinds and feeds the long medium from the roll-like medium by rotating the roll-like medium around the support shaft, the apparatus includes a mounting portion to which a first shaft becoming the support shaft is mounted with the movement of a direction perpendicular to the first shaft in a freely attached and detached manner; a second gear wheel that can be meshed with a first gear wheel integrally provided so as to be placed concentrically with the first shaft, and can be rotated around a second shaft which is disposed so as to be parallel to the first shaft in the state of being mounted to the mounting portion; and a displacement mechanism that is operated so as to displace the second gear wheel between a meshed position to be meshed with the first gear wheel that is in the state in which the first shaft is mounted to the mounting portion and a separated position separated from the first gear wheel.

According such a configuration, when the first shaft becoming the support shaft is attached to or detached from the mounting portion, by operating the displacement mechanism, it is possible to displace the second gear wheel to the separated position separated from the first gear wheel that is moved in the attachment and detachment direction relative to the mounting portion. For that reason, when the first shaft becoming the support shaft is attached to or detached from the mounting portion, it is avoided that the first gear wheel provided integrally with the first shaft comes into contact with the second gear wheel together with the movement load in the attachment and detachment direction. Thus, since these gear wheels are not damaged during attachment and detachment operation of the roll-like medium, it is possible to execute the attachment and detachment operation of the roll-like medium while suppressing damage to the components.

In the roll-like medium feeding apparatus of the aspect of the invention, the displacement mechanism may include a third gear wheel that can be rotated around a third shaft disposed so as to be parallel to the second shaft, and a fourth gear wheel that is meshed with the third gear wheel and can be rotated around a fourth shaft which is placed so as to be parallel to the second shaft to mediate the transmission of the power from the third gear wheel to the second gear wheel, wherein the second gear wheel is configured so as to be displaceable in a circumferential direction around the fourth shaft based on the power to be transmitted from the third gear wheel, and the third gear wheel rotates the fourth gear wheel around the fourth shaft based on the power to be transmitted to the second gear wheel and spreads the displacement force in the circumferential direction around the fourth shaft from the fourth shaft to the second gear wheel, thereby displacing the second gear wheel between the meshed position and the separated position.

According to such a configuration, when the power is transmitted from the third gear wheel to the second gear wheel via the fourth gear wheel together with the rotation of the third gear wheel, the second gear wheel is meshed with the first gear wheel or is separated from the meshed position while being displaced in the circumferential direction of the fourth shaft that is the rotation center of the fourth gear wheel. Moreover, after the second gear wheel is meshed with the first gear wheel, when the third gear wheel further rotates the second gear wheel in the meshed position via the fourth gear wheel, the power for the rotation also acts as a biasing force that biases the second gear wheel so as to be meshed with the first gear wheel. For that reason, since there is no need to specifically provide a member for operating the biasing force, the number of components can be reduced.

Furthermore, in the roll-like medium feeding apparatus of the aspect of the invention, the second gear wheel may be provided so as to form a pair on both sides with the first gear wheel interposed therebetween in the circumferential direction around the fourth shaft.

According such a configuration, when a pair of second gear wheels disposed with the first gear wheel interposed therebetween is displaced to the one side of the circumferential direction, based on the displacement force to the one side of the circumferential direction around the fourth shaft becoming the rotation center of the fourth gear wheel, among the pair of second gear wheels, the second gear wheel situated in the other side of the circumferential direction with respect to the first gear wheel is meshed with the first gear wheel. Meanwhile, when a pair of second gear wheels disposed with the first gear wheel interposed therebetween is displaced to the other side of the circumferential direction, based on the displacement force to the other side of the circumferential direction around the fourth shaft becoming the rotation center of the fourth gear wheel, among the pair of second gear wheels, the second gear wheel situated in the one side of the circumferential direction with respect to the first gear wheel is meshed with the first gear wheel. That is, even when the second gear wheel is displaced in any direction of the circumferential direction around the fourth shaft, among the pair of second gears, it is possible to mesh any one of the second gear wheel with the first gear wheel.

Furthermore, in the roll-like medium feeding apparatus of the aspect of the invention, the rotation direction of the second gear wheel in the meshed position around the second shaft based on the power from the third gear wheel may be a direction that presses the first gear wheel to be meshed with the second gear wheel toward the inside of the mounting direction in the mounting portion.

According to such a configuration, the second gear wheel presses the first gear wheel toward the inside of the mounting direction in the mounting portion by being rotated in the meshed position. For that reason, the support shaft, which is the first shaft integral with the first gear wheel, is also pressed toward the inside of the mounting direction in the mounting portion. Thus, it is possible to mount the roll-like medium supported by the support shaft in a stable state.

Furthermore, the roll-like medium feeding apparatus of aspect of the invention may further include a holding member that is capable of holding the second wheel gear in the separated position.

According to such a configuration, a situation in which the second gear wheel is displaced from the separated position to the meshed position contrary to the intent of the user is avoided. Thus, it is possible to prevent a user from attaching or detaching the first shaft as the support shaft supporting the roll-like medium to or from the mounting portion in advance in the state where the second gear wheel is meshed with the first gear wheel.

Furthermore, according to another aspect of the invention, there is provided a recording apparatus of the invention which includes the roll-like medium feeding apparatus having the configuration mentioned above, and a recording unit that performs the recording processing on the roll-like medium to be fed by the roll-like medium feeding apparatus.

According to such a configuration, it is possible to obtain the same effect as the invention of the roll-like medium feeding apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention, which is embodied to an ink jet type printer as a kind of a recording apparatus and a roll paper feeding apparatus included in the printer, will be described based on the drawings. In addition, in the description mentioned below, in the case of referring to "front and rear direction", "up and down direction", and "left and right direction", the directions refer to the "front and rear direction", "up and down direction", and "left and right direction" shown in arrows in FIG. 1 unless otherwise described. Furthermore, in this case, in regard to the "front and rear direction", the direction directed from the rear side to the front side corresponds to a transport direction of a target, the "up and down direction" corresponds to a vertical direction (a gravitational direction), and the "left and right direction" corresponds to a width direction intersecting the transport direction of the target.

Figure 1:
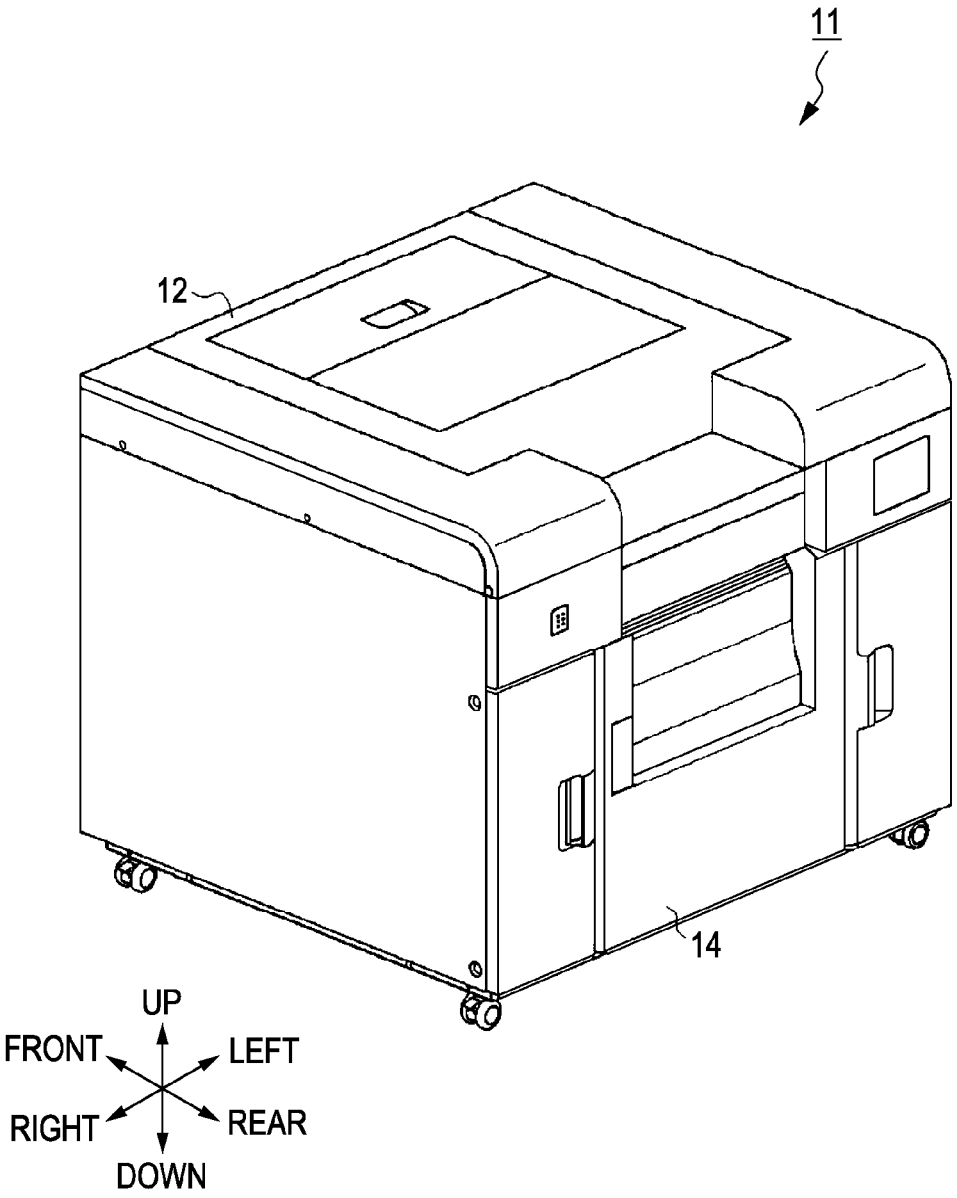
FIG. 1 is a perspective view of an ink jet type printer in the present embodiment.
Figure 2:
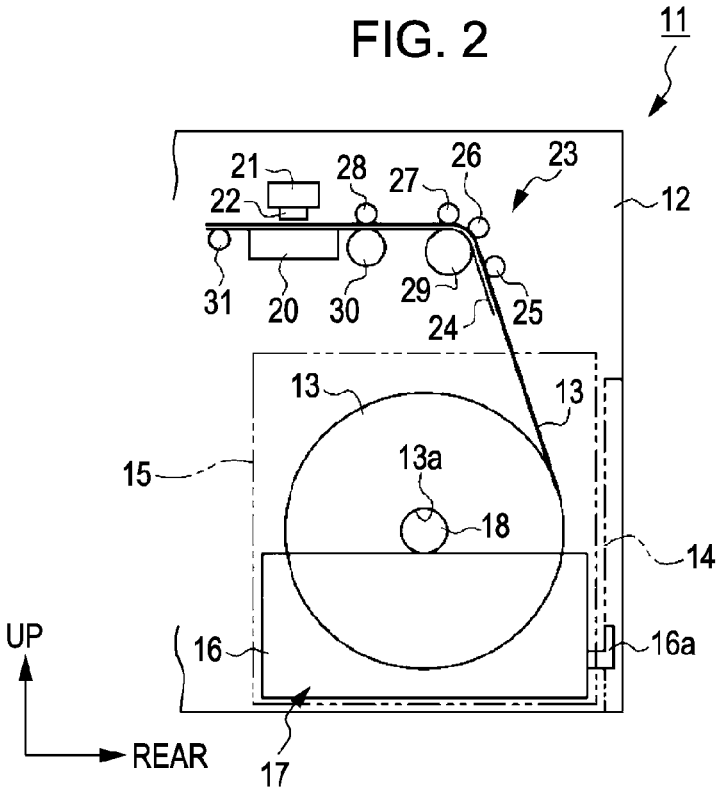
FIG. 2 is a schematic diagram that shows the state when a roll paper feeding apparatus is set in a roll paper accommodation portion.

As shown in FIGS. 1 and 2, an ink jet type printer 11 as a recording apparatus includes a main body frame 12 forming a rectangular shape. In a rear surface lower portion of the main body frame 12, a door 14 is provided which is opened or closed when setting a roll paper 13, around which an long continuous paper (medium) is wound, in a roll shape in the main body frame 12, or exchanging the roll paper 13 which is set in the main body frame 12. That is, in the position of the inside of the door 14 which is the lower position in the main body frame 12, a roll paper accommodation portion 15 for accommodating the roll paper 13 is provided.

Figure 3:
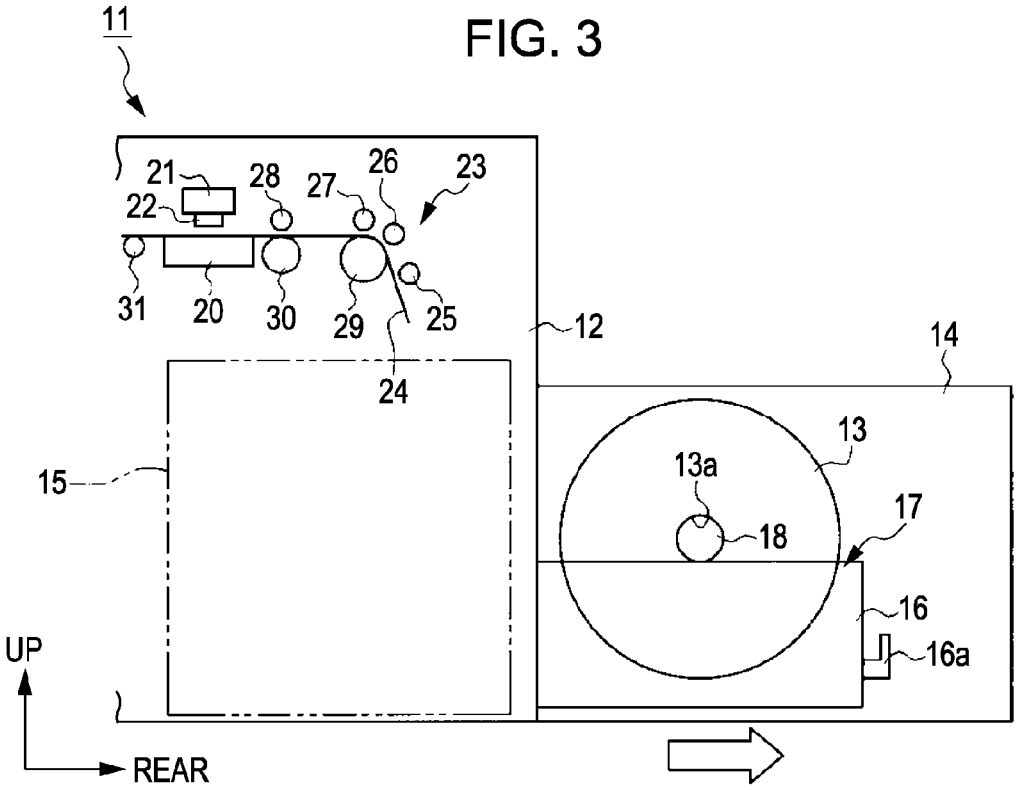
FIG. 3 is a schematic diagram that shows the state when a roll paper feeding apparatus is drawn out of a roll paper accommodation portion.

As shown in FIGS. 2 and 3, in the roll paper accommodation portion 15, a withdrawal member 16 is provided which is configured so as to be slidable and movable in the front and rear direction (a slide direction) with respect to the roll paper accommodation portion 15. That is, in the state of opening the door 14, the withdrawal member 16 can enter or leave the roll paper accommodation portion 15. In the rear end lower portion of the withdrawal member 16, a handle 16*a* for grasping the withdrawal member 16 upon slidably moving the same is provided.

Moreover, after the roll paper 13 is supported on the withdrawal member 16 via the roll paper feeding apparatus 17 as a roll-like medium feeding apparatus in the state of drawing out the withdrawal member 16 from the roll paper accommodation portion 15, when accommodating the withdrawal member 16 in the roll paper accommodation portion 15 again, the roll paper 13 is supported on the roll paper accommodation portion 15 via the roll paper feeding apparatus 17 so as to be rotatable around an axis extending in the left and right direction.

The roll paper feeding apparatus 17 includes a first shaft 18 that is a support shaft to be inserted into a center hole 13*a* of the roll paper 13. The first shaft 18 is extended in the left and right direction, and a first gear wheel 18*a* (see FIG. 4) is integrally provided in the right end thereof so as to be disposed concentrically with the first shaft 18.

In addition, a position (position shown in FIG. 3) of the withdrawal member 16 upon drawing the withdrawal member 16 from the roll paper accommodation portion 15 is a withdrawal position, and a position of the withdrawal member 16 (position shown in FIG. 2) of the withdrawal member 16 upon accommodating the withdrawal member 16 in the roll paper accommodation portion 15 is an accommodation position.

As shown in FIGS. 2 and 3, in the upper position of the roll paper accommodation portion 15 in the main body frame 12, a support plate 20 of a flat plate shape is disposed, which supports the roll paper 13 that is unwound from the roll paper accommodation portion 15, in the horizontal state. In the upper part of the support plate 20, a carriage 21 is provided so as to face the support plate 20, and a recording head 22 as a recording unit is supported on the lower surface of the carriage 21. Moreover, the carriage 21 is configured so as to be movable back and forth in the left and right direction by a driving unit (not shown), and ink is supplied from an ink cartridge (not shown) disposed in the main body frame 12 to the recording head 22.

Furthermore, in the main body frame 12, a transport mechanism 23 is provided which transports the roll paper 13 supported by the roll paper accommodation portion 15 onto the support plate 20 along the transport path of the roll paper 13. The transport mechanism 23 includes a guide plate 24 which guides the roll paper 13 unwound from the roll paper accommodation portion 15 along the transport path, and a plurality of transport rollers 25 to 31 which is disposed along the transport path and transports the roll paper 13 to the support plate 20 side.

Moreover, by sequentially transporting the roll paper 13 supported by the roll paper accommodation portion 15 onto the support plate 20 by the transport mechanism 23 and ejecting ink from the recording head 22 to the roll paper 13 on the support plate 20 while causing the carriage 21 to reciprocate in the left and right direction by the driving unit (not shown), the printing processing (the recording processing) is performed on the roll paper 13. In addition, the roll paper 13 after the printing processing is dried by a dryer (not shown) disposed in the downstream side relative to the support plate 20 in the transport path, and then is sequentially wound by a winding shaft (not shown).

Figure 4:
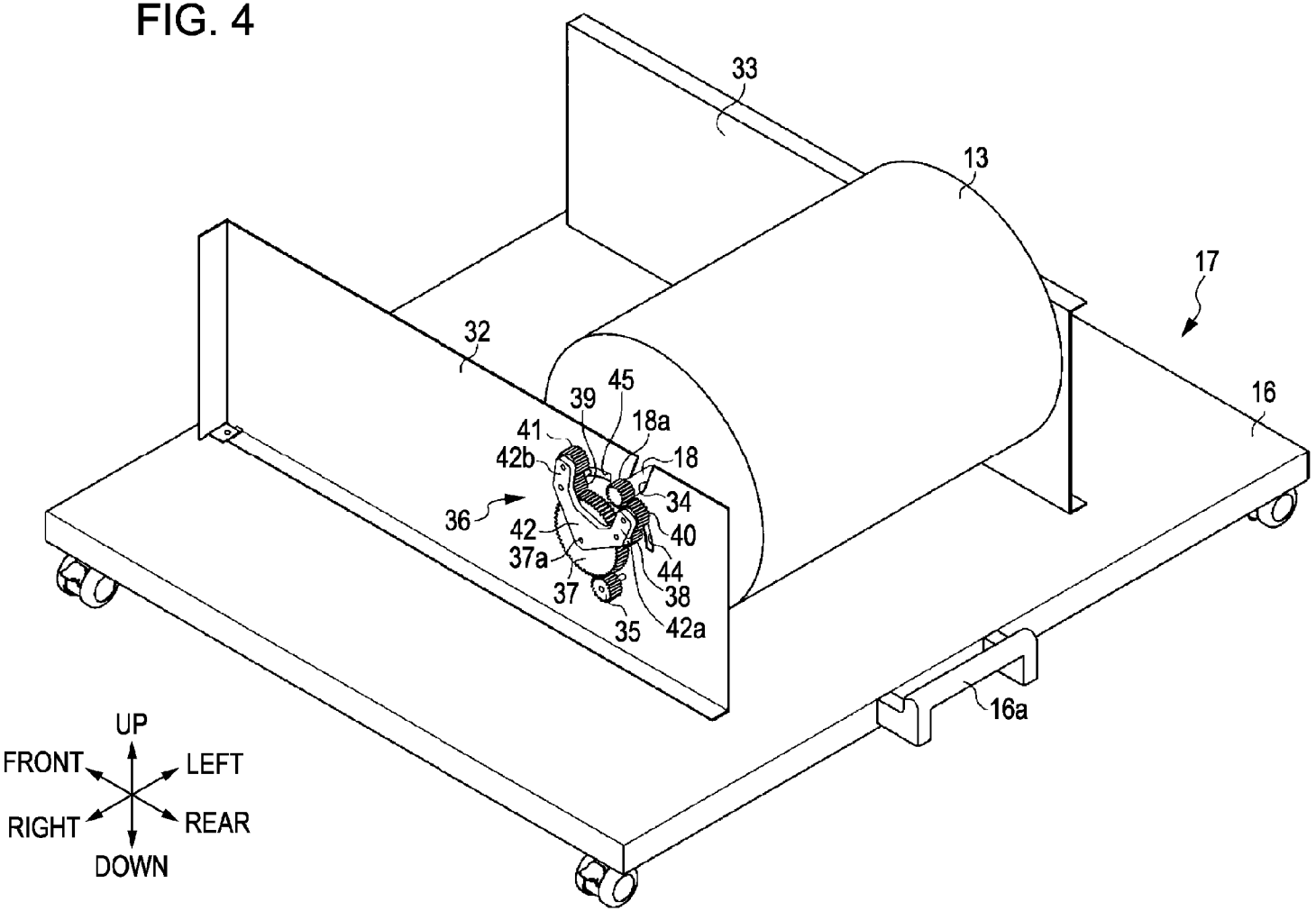
FIG. 4 is a perspective view of a roll paper feeding apparatus.

As shown in FIG. 4, in the roll paper feeding apparatus 17, a pair of support side plates 32 and 33 forming a rectangular plate shape is provided so as to face the upper surface of the withdrawal member 16 at intervals in the left and right direction. Furthermore, in the right support side plate 32 among the pair of support side plates 32 and 33, in a portion near the rear part of the upper end surface, a notch groove 34 is formed which functions as a mounting portion making the first shaft 18 freely attachable and detachable. The upper end side of the notch groove 34 is opened and the lower end side thereof is closed, and the notch groove 34 is formed so as to be inclined and extended from the upper end side toward the front oblique lower part. Moreover, in the state in which the first shaft 18 inserted into the center hole 13*a* of the roll paper 13 is supported from the lower portion by an arc-shaped inner part of the notch groove 34, the first gear wheel 18*a* of the right end of the first shaft 18 is situated in the outside (the right side) of the support side plate 32.

Figure 5:
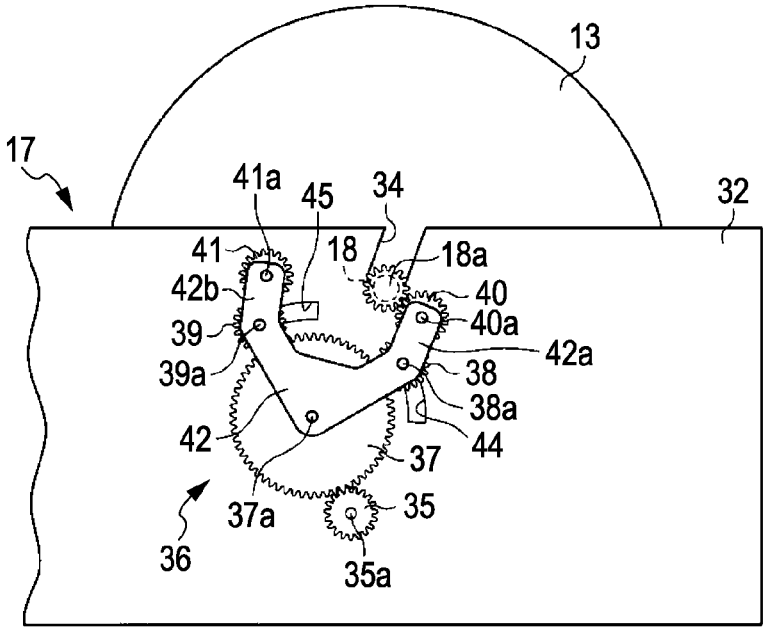
FIG. 5 is a side view in which a displacement mechanism in a roll paper feeding apparatus is viewed from the outside of a support side plate.

Furthermore, as shown in FIGS. 4 and 5, in the position which is the lower than the inner part of the notch groove 34 in the right support side plate 32, a third shaft 35*a* parallel to the first shaft 18 mounted in the notch groove 34 penetrates the support side late 32 and is rotatably supported, and at the right end portion in the third shaft 35*a*, a third gear wheel 35 functioning as the driving gear wheel is supported so as to be rotated together with the third shaft 35*a*.

Figure 6:
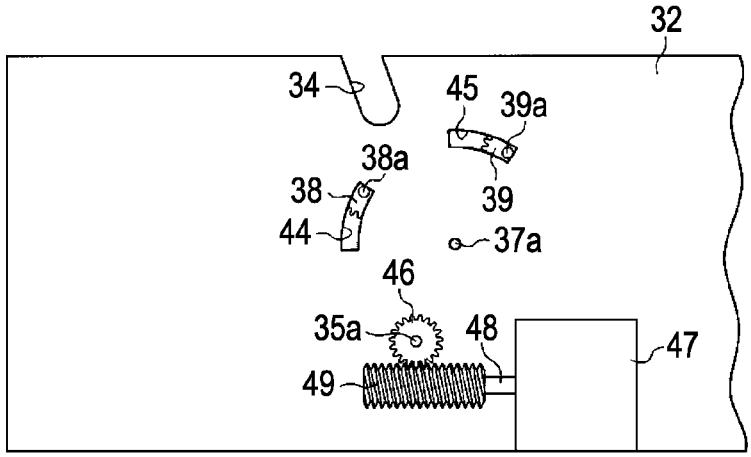
FIG. 6 is a side view in which a displacement mechanism in a roll paper feeding apparatus is viewed from the inside of a support side plate.

Furthermore, as shown in FIG. 6, in the left end portion of the third shaft 35*a* protruded toward the inside (that is, the left side surface of the support side plate 32) of the right support side plate 32, a sixth gear wheel 46 becoming a relay gear wheel is supported so as to be rotated integrally with the third shaft 35*a*. Furthermore, a worm gear 49 provided in the tip portion of the output shaft 48 of the driving motor 47 is meshed with the sixth gear wheel 46 in a power-transmissible manner. Moreover, the sixth gear wheel 46 is able to be rotated in the forward and backward direction by the driving force of the driving motor 47.

Furthermore, in the outside (that is, the right surface side of the support side plate 32) of the support side plate 32, a planetary gear wheel mechanism 36 is provided which can connect the third gear wheel 35 and the first gear wheel 18*a* in the power-transmissible manner. As shown in FIG. 5, the planetary gear wheel mechanism 36 includes a fourth gear wheel 37 becoming a sun gear wheel, fifth gear wheels 38 and 39 and the second gear wheels 40 and 41 becoming a plurality (in the present embodiment, four) of planetary gear wheels circulating around the fourth gear wheel 37, and a base member 42 which oscillates while rotatably supporting the fifth gear wheels 38 and 39 and the second gear wheels 40 and 41 and.

The base member 42 forms an approximately V shape in which a pair of arm portions 42*a* and 42*b* is extended so as to branch from the proximal end portion when viewed from the side, and the proximal end portion is rotatably supported by the fourth shaft 37*a* becoming the rotation shaft of the fourth gear wheel 37. Furthermore, in the pair of arm portions 42*a* and 42*b* formed in the base member 42, the fifth gear wheels 38 and 39 and the second gear wheels 40 and 41 are rotatably supported via the respective shafts 38*a*, 39*a*, 40*a*, and 41*a*. Moreover, among the respective gear wheels 38 to 41 becoming the planetary gear wheels, the fifth gear wheels 38 and 39 meshed with the fourth gear wheel 37 function as the relay gear wheel, and meanwhile, the second gear wheels 40 and 41 meshed with the fifth gear wheels 38 and 39 function as a power transmission gear wheel that transmits the power, which is transmitted from the fourth gear wheel 37 via the fifth gear wheels 38 and 39, to the first gear wheel 18*a*. Furthermore, in the present embodiment, the driving motor 47, the third gear wheel 35, the fourth gear wheel 37, the fifth gear wheels 38 and 39, the base member 42 or the like constitute a displacement mechanism that displaces the second gear wheels 40 and 41 between the meshed position relative to the first gear wheel 18*a* and the separated position separated from the first gear wheel 18*a*.

In addition, the second gear wheels 40 and 41 are configured so as to be separated and disposed from the fourth shaft 37*a* of the fourth gear wheel 37 at substantially the same distance with respect to the first gear wheel 18*a* in the state in which the first shaft 18*a* is supported by the arc-shaped inner part of the notch groove 34 formed in the support side plate 32 from the lower part. That is, the second gear wheels 40 and 41 are disposed so as to form a pair with the first gear wheel 18*a* interposed therebetween on the same circumference around the fourth shaft 37*a* of the fourth gear wheel 37. Moreover, the second gear wheels 40 and 41 are displaceable so as to be circularly rotated around the fourth gear wheel 37 around the fourth shaft 37*a* of the fourth gear wheel 37 between the meshed position (for example, the state of FIG. 5) meshed with the first gear wheel 18*a* and the non-meshed position (for example, the state of FIG. 7) which is not meshed with the first gear wheel 18*a*.

Furthermore, as shown in FIG. 6, in the support side plate 32, two long holes 44 and 45 forming an approximately fan shape around the fourth shaft 37*a* of the fourth gear wheel 37 as a diameter center are formed so as to penetrate the support side plate 32 in the left and right direction. These long holes 44 and 45 are disposed with respect to the fifth gear wheels 38 and 39 supported by the base member 42 at substantially the same distance from the fourth shaft 37*a* of the fourth gear wheel 37. Moreover, in these long holes 44 and 45, the tip portions (the left end portions in the present embodiment) of the fifth shafts 38*a* and 39*a*, in which the fifth gear wheels 38 and 39 are rotatably supported on the respective arm portions 42*a* and 42*b* of the base member 42, are individually inserted. For that reason, when the fifth gear wheels 38 and 39 are circularly rotated around the fourth gear wheel 37, the fifth shafts 38*a* and 39*a* becoming the rotation center of the fifth gear wheels 38 and 39 come into contact with each inner end edge of the inner end side and the other end side of the longitudinal direction in the long holes 44 and 45, thereby restricting the circular rotation ranges of the fifth gear wheels 38 and 39 in the circumferential direction around the fourth shaft 37*a* of the fourth gear wheel 37.

Next, the action of the printer 11 configured as above will be described, particularly, focusing on the action when the second gear wheels 40 and 41 are displaced between the meshed position relative to the first gear wheel 18*a* and the non-meshed position.

Figure 7:
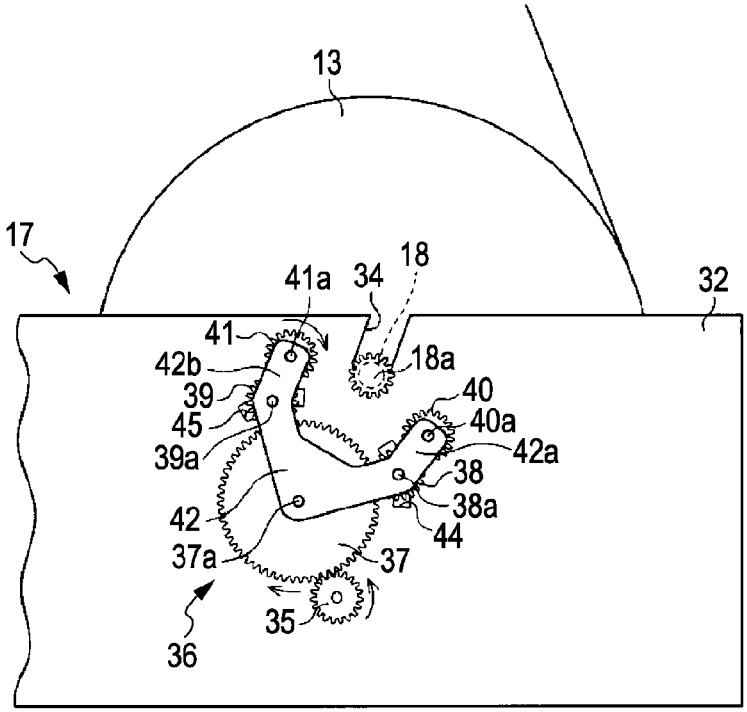
FIG. 7 is a side view that shows a middle state in which a displacement mechanism is operated along with a forward rotation driving of a driving motor.

Incidentally, when the first shaft 18 with the roll paper 13 wound therearound is mounted to the roll paper feeding apparatus 17, as shown in FIG. 7, the planetary gear wheel mechanism 36 is situated in the non-meshed position where neither of the second gear wheels 40 and 41 are meshed with the first gear wheel 18*a*. For that reason, in the case of mounting the first shaft 18 to the roll paper feeding apparatus 17 in that state, since the first gear wheel 18*a* is not meshed with the second gear wheels 40 and 41, the mounting operation of the first gear wheel 18*a* is not hindered.

Moreover, when the roll paper 13 is unwound from the first shaft 18 after the first shaft 18 is mounted to the roll paper feeding apparatus 17, there is a need to transmit the power from the driving motor 47 to the first shaft 18 by connecting the first gear wheel 18*a* and the third gear wheel 35 via the planetary gear wheel mechanism 36 in the power-transmissible manner. In this respect, in the present embodiment, as described below, the planetary gear wheel mechanism 36 connects the first gear wheel 18*a* with the third gear wheel 35 in the power-transmissible manner.

Firstly, the driving motor 47 is rotated and driven in the forward rotation direction so that it can transmit the driving force, which unwinds the roll paper 13 from the first shaft 18, to the first shaft 18. Then, along with the forward rotation driving of the driving motor 47, the third gear wheel 35 is rotated and driven in a counterclockwise direction shown in FIG. 7. Moreover, the fourth gear wheel 37, which is meshed with the third gear wheel 35 in the power-transmissible manner, is rotated around the fourth shaft 37*a* of the fourth gear wheel 37 in the clockwise direction shown in FIG. 7 in connection with the rotation power of the third gear wheel 35.

In this case, the fifth gear wheels 38 and 39 meshed with the fourth gear wheel 37 are supported by the base member 42 so as to be displaceable in the circumferential direction around the fourth shaft 37*a* of the fourth gear wheel 37. For that reason, the fifth gear wheels 38 and 39 are circularly rotated so as to revolve around the fourth gear wheel 37 in the clockwise direction shown in FIG. 7 around the fourth shaft 37*a* of the fourth gear wheel 37 without changing the meshed part relative to the fourth gear wheel 37 based on the driving force to be transmitted from the fourth gear wheel 37.

Figure 8:
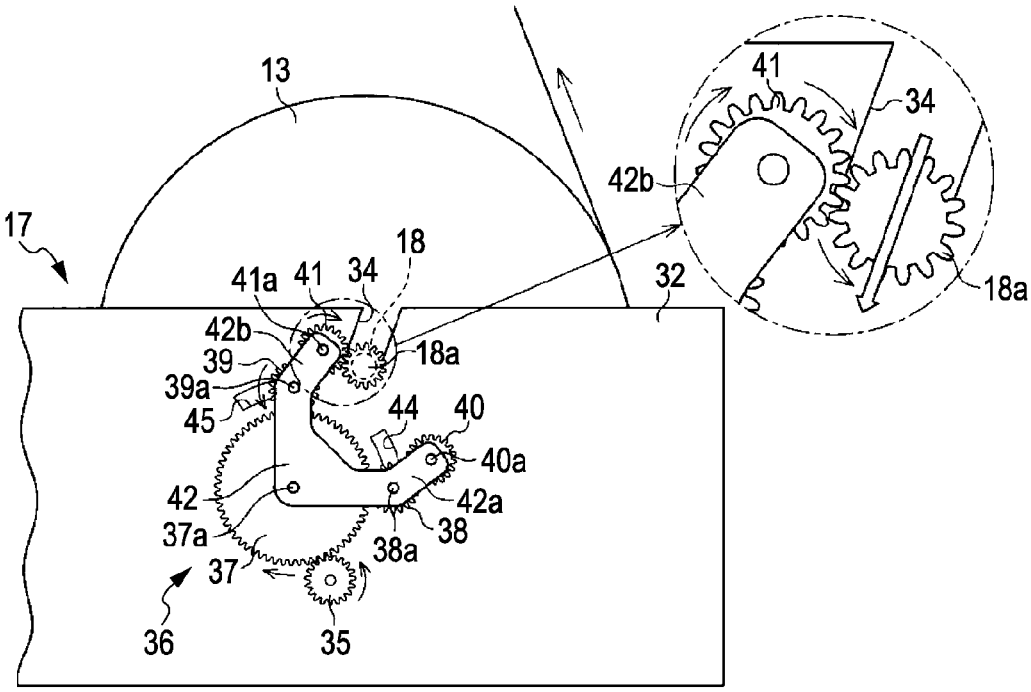
FIG. 8 is a side view that shows the state after a second gear wheel is displaced up to a meshed position relative to a first gear wheel by the operation of a displacement mechanism along with a forward rotation driving of a driving motor.

Furthermore, similarly, the second gear wheels 40 and 41 meshed with the fifth gear wheels 38 and 39 are supported by the base member 42 so as to be displaceable in the circumferential direction around the fourth shaft 37*a* of the fourth gear wheel 37. For that reason, the second gear wheels 40 and 41 are circularly rotated around the fourth gear wheel 37 integrally with the fifth gear wheels 38 and 39 in the clockwise direction shown in FIG. 7 around the fourth shaft 37*a* of the fourth gear wheel 37 without changing the meshed part relative to the fifth gear wheel 39. That is, the rotation force around the fourth shaft 37*a* in the fourth gear wheel 37 acts on the second gear wheels 40 and 41 as the displacement force in the circumferential direction around the fourth shaft 37*a* of the fourth gear wheel 37. Moreover, as shown in FIG. 8, among the second gear wheels 40 and 41, the second gear wheel 41 situated at the backside of the fourth gear wheel 37 in the rotation direction when viewed from the first gear wheel 18*a* is displaced up to the meshed position relative to the first gear wheel 18*a*.

At the point of time when the second gear wheel 41 is displaced up to the meshed position relative to the first gear wheel 18*a*, the fifth shafts 38*a* and 39*a* becoming the rotation center of the fifth gear wheels 38 and 39 are engaged by the inner end edges of long holes 44 and 45 of the support side plate 32. For that reason, the circular rotation range of the fifth gear wheels 38 and 39 is regulated in the circumferential direction around the fourth shaft 37*a* of the fourth gear wheel 37. As a result, the fifth gear wheels 38 and 39 cannot be further circularly rotated around the fourth shaft 37*a* of the fourth gear wheel 37 in connection with the rotation of the fourth gear wheel 37.

Then, the fifth gear wheels 38 and 39 are rotated around the fifth shafts 38*a* and 39*a* based on the driving force to be transmitted from the fourth gear wheel 37. Furthermore, since the second gear wheels 40 and 41 are supported by the base member 42 so as to always be meshed with the fifth gear wheels 38 and 39, the second gear wheels 40 and 41 are rotated based on the driving force to be transmitted from the fifth gear wheels 38 and 39. In addition, the rotation directions of the gear wheels meshed with each other are opposite to each other. For that reason, the rotation directions of the second gear wheels 40 and 41 connected to the fourth gear wheel 37 via the fifth gear wheels 38 and 39 are the same as that of the fourth gear wheel 37.

Moreover, when the second gear wheel 41 is rotated in the state of being meshed with the first gear wheel 18*a*, the driving force of the driving motor 47 is transmitted to the first gear wheel 18*a* through the second gear wheel 41, and thus, the first gear wheel 18*a* is rotated. Herein, the rotation direction of the first gear wheel 18*a* is opposite to the rotation direction of the second gear wheel 41, and the first gear wheel 18*a* is rotated in the counterclockwise direction shown in FIG. 8. As a result, force acts on the first shaft 18 from the second gear wheel 41 toward the inner part side of the notch groove 34 formed in the support side plate 32. That is, since force acts on the first gear wheel 18*a* from the second gear wheel 41 in a direction adhering to the inner part forming the arch shape of the notch groove 34 of the support side plate 32, the first gear wheel 18*a* is meshed with the second gear wheel 41 in a stable state. Thus, since the driving force is reliably transmitted from the driving motor 47 to the first shaft 18, it is possible to reliably send out the roll paper 13 from the first shaft 18.

Figure 9:
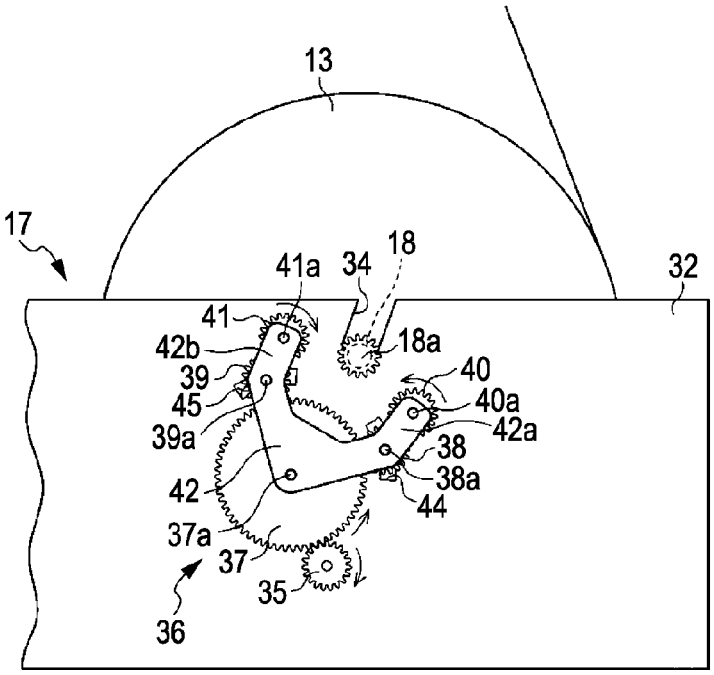
FIG. 9 is a side view that shows a midst state in which a displacement mechanism is operated along with a backward rotation driving of a driving motor.

Meanwhile, in the case of removing the first shaft 18 with the roll paper 13 wound therearound from the roll paper feeding apparatus 17, there is a need to rewind the roll paper 13, which is sent out from the first shaft 18, around the first shaft 18. In this case, the driving motor 47 is rotated and driven in the backward rotation direction so that it can transmit the driving force rewinding the roll paper 13 around the first shaft 18 to the first shaft 18 in the state shown in FIG. 8. Then, as shown in FIG. 9, along with the backward rotation driving of the driving motor 47, the third gear wheel 35 is rotated and driven in the clockwise direction shown in FIG. 9. Moreover, the fourth gear wheel 37 meshed with the third gear wheel 35 in the power-transmissible manner is rotated in the counterclockwise direction shown in FIG. 9 around the fourth shaft 37*a* of the fourth gear wheel 37 in connection with the rotation driving of the third gear wheel 35.

Figure 10:
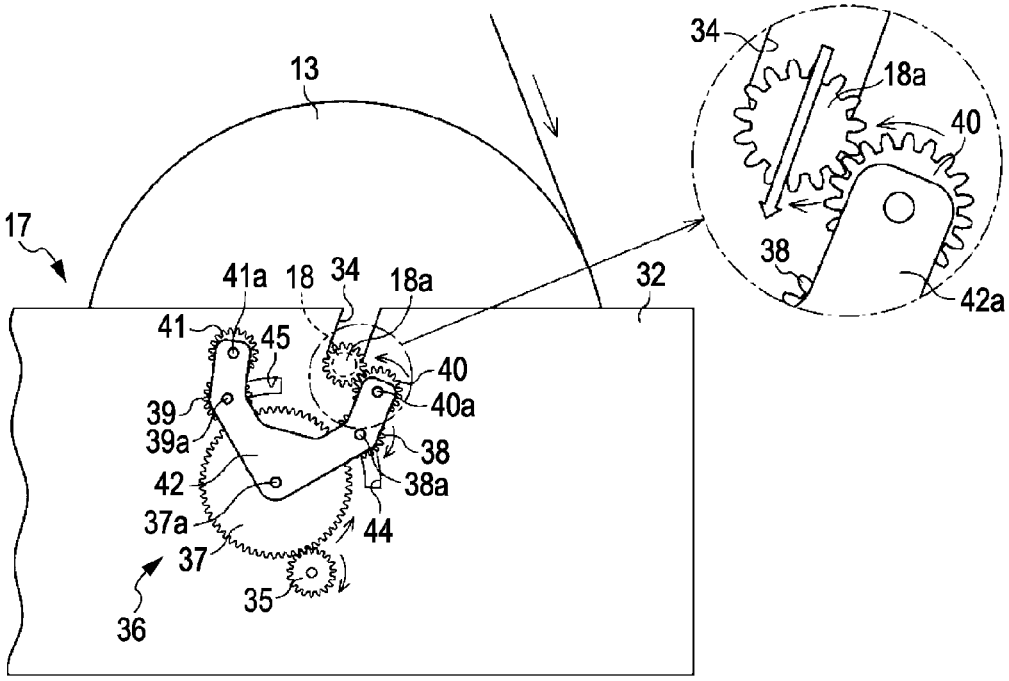
FIG. 10 is a side view that shows the state after a second gear wheel is displaced up to a meshed position relative to a first gear wheel by the operation of a displacement mechanism along with a backward rotation driving of a driving motor.

In this case, the fifth gear wheels 38 and 39 and the second gear wheels 40 and 41 are circularly rotated around the fourth gear wheel 37 in the counterclockwise direction shown in FIG. 9 around the fourth shaft 37*a* of the fourth gear wheel 37 in connection with the rotation of the fourth gear wheel 37. Moreover, as shown in FIG. 10, among the second gear wheels 40 and 41, the second gear wheel 40 situated in the backside of the rotation direction of the fourth gear wheel 37 when viewed from the first gear wheel 18*a* is displaced up to the meshed position relative to the first gear wheel 18*a*.

Furthermore, at the point of time when the second gear wheel 40 is displaced up to the meshed position relative to the first gear wheel 18*a*, the fifth shafts 38*a* and 39*a* in the fifth gear wheels 38 and 39 are engaged by the respective inner end edges of long holes 44 and 45 of the support side plate 32. For that reason, the circular rotation range of the fifth gear wheels 38 and 39 is regulated in the circumferential direction around the fourth shaft 37*a* of the fourth gear wheel 37. As a result, the fifth gear wheels 38 and 39 cannot be further circularly rotated around the fourth shaft 37*a* of the fourth gear wheel 37 in connection with the rotation of the fourth gear wheel 37.

Then, the fifth gear wheels 38 and 39 are rotated around the fifth shafts 38*a* and 39*a* based on the driving force to be transmitted from the fourth gear wheel 37. Furthermore, the second gear wheels 40 and 41 meshed with the fifth gear wheels 38 and 39 are rotated based on the driving force to be transmitted from the fifth gear wheels 38 and 39.

Moreover, when the second gear wheel 40 is rotated in the state of being meshed with the first gear wheel 18*a*, the driving force of the driving motor 47 is transmitted to the first gear wheel 18*a* through the second gear wheel 40, and thus, the first gear wheel 18*a* is rotated. In this case, force acts on the first shaft 18 from the second gear wheel 40 so as to adhere to the inner part forming the arch shape of the notch groove 34 formed in the support side plate 32. Accordingly, since the driving force is reliably transmitted from the driving motor 47 to the first shaft 18, it is possible to reliably rewind the roll paper 13 from the first shaft 18.

Moreover, when the rewinding of the roll paper 13 around the first shaft 18 is completed, the third gear wheel 35 starts to be rotated and driven from the state shown in FIG. 10 in the forward rotation direction. Then, the driving force from the third gear wheel 35 is transmitted to the second gear wheel 40, whereby the second gear wheel 40 is separated from the first gear wheel 18*a* so as to release the meshed state relative to the first gear wheel 18*a*. For that reason, when removing the first shaft 18 from the roll paper feeding apparatus 17 in that state, the first gear wheel 18*a* is meshed with the second gear wheels 40 and 41, whereby the removal operation of the first shaft 18 is not impeded.

In addition, in the state in which the third gear wheel 35 is connected to the second gear wheels 40 and 41 in the power-transmissible manner, the driving load of the driving motor 47 acts on the second gear wheels 40 and 41. For that reason, even if the transmission of the driving force from the driving motor 47 is stopped in the state in which the second gear wheel 41 is separated from the first gear wheel 18*a*, it is restricted that the second gear wheel 41 is displaced up to the position meshed with the first gear wheel 18*a* along the self weight thereof. In this respect, in the present embodiment, the driving motor 47 also functions as a holding member that holds the second gear wheels 40 and 41 in the position separated from the first gear wheel 18*a*.

Thus, according to the present embodiment, the effects described below can be obtained.

(1) When the first shaft 18 is attached to or detached from the notch groove 34, it is possible to displace the second gear wheel to the separated position separated from the first gear wheel 18*a* moved in the attachment and detachment direction relative to the notch groove 34 by operating the planetary gear wheel mechanism 36. For that reason, when the first shaft 18 is attached to or detached from the notch groove 34, a situation in which the first gear wheel 18*a* provided integrally with the first shaft 18 comes into contact with the second gear wheels 40 and 41 along with the movement load in the attachment and detachment direction is avoided. Thus, since the gear wheels 18*a*, 40, and 41 are not damaged during the attachment and detachment operation of the roll paper 13, it is possible to execute the attachment and detachment operation of the roll paper 13 while suppressing the damage to the components.

(2) When the power from the third gear wheel 35 is transmitted to the second gear wheels 40 and 41 via the fifth gear wheels 38 and 39 along with the rotation of the third gear wheel 35, the second gear wheels 40 and 41 are meshed with the first gear wheel 18*a* or separated from the meshed position while being displaced in the circumferential direction around the fourth shaft 37*a* becoming the rotation center of the fourth gear wheel 37. Moreover, after meshing the second gear wheels 40 and 41 with the first gear wheel 18*a*, when the third gear wheel 35 further rotates the second gear wheels 40 and 41 in the meshed position via the fourth gear wheel 37, the power for rotation also acts as the biasing force of biasing the second gear wheels 40 and 41 so as to be meshed with the first gear wheel 18*a*. For that reason, since there is no need to specifically provide a member for causing the biasing force to act, the number of components can be reduced.

(3) When the pair of the second gear wheels 40 and 41 disposed with the first gear wheel 18*a* interposed therebetween is displaced to one side of the circumferential direction based on the displacement force to the one side of the circumferential direction around the fourth shaft 37*a* becoming the rotation center of the fourth gear wheel 37, among the pair of the second gear wheels 40 and 41, the second gear wheels 40 and 41 situated in the other side of the circumferential direction with respect to the first gear wheel 18*a* are meshed with the first gear wheel 18*a*. Meanwhile, when the pair of the second gear wheels 40 and 41 disposed with the first gear wheel 18*a* interposed therebetween is displaced to the other side of the circumferential direction based on the displacement force to the other side of the circumferential direction around the fourth shaft 37*a* becoming the rotation center of the fourth gear wheel 37, among the pair of the second gear wheels 40 and 41, the second gear wheels situated in the one side of the circumferential direction with respect to the first gear wheel are meshed with the first gear wheel 18*a*. That is, even when the second gear wheels 40 and 41 are displaced in any direction of the circumferential direction around the fourth shaft, it is possible to mesh any one second gear wheel among the pair of the second gear wheels 40 and 41 with the first gear wheel 18*a*.

(4) The second gear wheels 40 and 41 presses the first gear wheel 18*a* toward the inside of the mounting direction in the notch groove 34 by being rotated in the meshed position. For that reason, the first shaft 18 integral with the first gear wheel 18*a* is also pressed toward the inside of the mounting direction in the notch groove 34. Thus, it is possible to mount the roll paper 13 supported by the first shaft 18 in a stable state.

(5) A situation in which the second gear wheels 40 and 41 are displaced from the separated position to the meshed position contrary to intent of a user is avoided. Thus, in the state in which the second gear wheels 40 and 41 are situated in the meshed position relative to the first gear wheel 18*a*, it is possible to prevent a user from attaching or detaching the first shaft 18 supporting the roll paper 13 to or from the notch groove 34, in advance.

In addition, the embodiment described above may be changed to other embodiments.

In the embodiment described above, the planetary gear wheel mechanism 36 may be configured to provide a holding member for holding the rotation posture of the base member 42 around the fourth shaft 37*a* of the fourth gear wheel 37 as another member configuration different from the driving motor 47.

In the embodiment described above, the number of the fifth gear wheels 38 and 39 provided between the second gear wheels 40 and 41 and the fourth gear wheel 37 may be an even number, and may be configured so as to mesh the second gear wheels 40 and 41 with the fourth gear wheel 37 in the power-transmissible manner. That is, it may be configured so that the rotation direction of the fourth gear wheel 37 is opposite to the rotation direction of the second gear wheels 40 and 41 based on the driving force to be transmitted from the fourth gear wheel 37.

In the embodiment described above, the shape of the base member 42 is not limited to an approximately V shape, but any configuration can be adopted if the configuration is capable of realizing placeability in which the second gear wheels 40 and 41 form a pair with the first gear wheel 18*a* interposed therebetween, when the driving motor 47 is driven for the forward rotation and the backward rotation.

In the embodiment described above, the planetary gear wheel mechanism 36 may have another member configuration different from the driving force to be transmitted from the driving motor 47 to the second gear wheels 40 and 41, and may have a configuration that includes a biasing member which causes the biasing force to act in the direction of meshing the second gear wheels 40 and 41 with the first gear wheel 18*a*. In this case, when the driving motor 47 is driven for the forward rotation and the backward rotation, the gear wheel meshed with the first gear wheel 18*a* may be a common gear.

Moreover, in the configuration, when the driving motor 47 is driven for the forward rotation and the backward rotation, based on the driving force to be transmitted from the fourth gear wheel 37 to the second gear wheels 40 and 41, the second gear wheels 40 and 41 maintain the meshed state relative to the first gear wheel 18*a* based on the biasing force from the biasing member. Meanwhile, upon being driven to any one of the forward rotation and the backward rotation, the driving motor 47 transmits the driving force to the second gear wheels 40 and 41 in the direction of separating the second gear wheels 40 and 41 from the first gear wheel 18*a*. Moreover, when the driving amount during one driving is increased, the driving motor 47 can displace the second gear wheels 40 and 41 so as to be separated from the first gear wheel 18*a* to resist the biasing force from the biasing member, based on the driving force to be transmitted from the fourth gear wheel 37 to the second gear wheels 40 and 41.

In the embodiment described above, the driving member for giving the driving force for displacing the second gear wheels 40 and 41 between the meshed position meshed with the first gear wheel 18*a* and the separated position separated from the first gear wheel 18*a* may be provided by another member configuration different from the driving motor 47 for rotating and driving the first gear wheel 18*a* through the second gear wheels 40 and 41.

In the embodiment described above, the driving motor 47 for giving the driving force for displacing the second gear wheels 40 and 41 between the meshed position meshed with the first gear wheel 18*a* and the separated position separated from the first gear wheel 18*a* may be omitted. In this case, for example, the planetary gear wheel mechanism 36 may produce back tension on the roll paper 13 to be unwound from the first shaft 18. Moreover, in such a configuration, a user manually operates the planetary gear wheel mechanism 36, which makes it possible to displace the second gear wheels 40 and 41 between the meshed position meshed with the first gear wheel 18*a* and the separated position separated from the first gear wheel 18*a*.

In the embodiment described above, the driving motor 47 may directly rotate and drive the third gear wheel 35 without going through the worm gear 49.

In the embodiment described above, the long medium is not limited to a continuous paper but may be a fabric or a resin film, a resin sheet, a metallic sheet or the like.

In the embodiment described above, although the ink jet type printer 11 is adopted as the recording apparatus, a fluid ejecting apparatus may be adopted which ejects another fluid other than ink. Furthermore, the recording apparatus can be applied to various liquid ejecting apparatuses that include a liquid ejecting head or the like for ejecting a small amount of liquid droplets. In this case, the liquid droplet refers to the state of liquid to be ejected from the liquid ejecting apparatus and also includes liquid which leaves traces in a granular shape, a tear shape, or a thread shape. Furthermore, liquid may be any material that can be ejected by the liquid ejecting apparatus. For example, the material may be one in which the substance is the state of the liquid phase, and the material includes a liquid body having high or low viscosity, sol, gel water, other inorganic solvent, organic solvent, solution, liquid phase resin, a flow-shaped body such as liquid phase metal (metallic melt), liquid as one state of substance, as well as one in which particles of a functional material formed of a solid substance such as pigment or metallic particles are dissolved, dispersed or mixed in the solvent. Furthermore, a typical example of liquid includes ink as described in the embodiment described above, a liquid crystal or the like. Herein, ink includes various ink compositions such as a general water-based ink, an oil-based ink, a gel ink, and a hotmelt ink. As a specific example of the liquid ejecting apparatus, for example, a liquid ejecting apparatus for ejecting liquid may be used which includes a material such as an electrode material or a color material to be used in manufacturing a liquid crystal display, an EL (electroluminescence) display, a plane emission display, a color filter, or the like in the form of a dispersion or a dissolution. Furthermore, the liquid ejecting apparatus may be a liquid ejecting apparatus that ejects bio organic matter to be used in manufacturing a bio chip, a liquid ejecting apparatus which is used as a precision pipette and ejects liquid becoming a sample, a printing apparatus, a micro dispenser or the like. Furthermore, it may be possible to adopt a liquid ejecting apparatus which ejects a lubricant oil to a precision machine such as a watch or a camera by a pinpoint, a liquid ejecting apparatus which ejects a transparent resin liquid such as an ultraviolet-curing resin onto the substrate so as to form a micro hemispherical lens (an optical lens) to be used in an optical communication element or the like, and a liquid ejecting apparatus which ejects an etching liquid such as acid or alkaline so as to etch the substrate or the like. Moreover, it is possible to apply the invention to any of these kinds of liquid ejecting apparatus. Furthermore, liquid may be a granular object such as toner. In addition, fluid described in the present specification does not include one which is formed of only gas.

In the embodiment described above, the recording apparatus is not limited to the liquid ejecting apparatus, but may be applied to, for example, a facsimile apparatus, a copy apparatus or the like. Depending on the apparatus for application, a recording agent during recording may be a powder-shaped toner instead of fluid such as ink.

What is claimed is:

1. A roll medium feeding apparatus in which a first support shaft supporting a roll medium with a long medium wound in a roll shape is mounted in a freely attached and detached manner, and which unwinds and feeds the long medium from the roll medium by rotating the roll medium around the first support shaft, comprising:

a mounting portion to which the first support shaft, which supports a roll medium, is mounted, the first support shaft is freely attached and detached from the mounting portion in a direction perpendicular to a longitudinal axis of the first support shaft, wherein a notch is formed in the mounting portion and includes an upper end that is open and a lower end that is closed, wherein the notch is inclined from the upper end toward the lower end, wherein the first support shaft is rotatably supported by the lower end of the notch;

a pair of second gear wheels that can be meshed with a first gear wheel that is integrally provided on the first support shaft and is disposed concentrically with the first support shaft, the pair of second gear wheels can be rotated around a second shaft which is disposed so as to be parallel to the first support shaft which is mounted to the mounting portion; and a displacement mechanism which is operated so as to displace each of the pair of second gear wheels between a meshed position to be meshed with the first gear wheel and a separated position separated from the first gear wheel.

2. The roll medium feeding apparatus according to claim 1, wherein the displacement mechanism includes a third gear wheel that can be rotated around a third shaft disposed so as to be parallel to the second shaft, and a fourth gear wheel that is meshed with the third gear wheel and can be rotated around a fourth shaft which is placed so as to be parallel to the second shaft to mediate the transmission of the power from the third gear wheel to the second gear wheel, the second gear wheel is configured so as to be displaceable in a circumferential direction around the fourth shaft based on the power which is transmitted from the third gear wheel, and the third gear wheel rotates the fourth gear wheel around the fourth shaft based on the power to be transmitted to the second gear wheel and spreads the displacement force in the circumferential direction around the fourth shaft from the fourth gear wheel to the second gear wheel, thereby displacing the second gear wheel between the meshed position and the separated position.

3. The roll medium feeding apparatus according to claim 2, wherein the pair of second gear wheels are provided so as to position one second gear wheel of the pair of second gear wheels on each side of the first gear wheel which is interposed therebetween the pair of second gear wheels in the circumferential direction around the fourth shaft.

4. The roll medium feeding apparatus according to claim 2, wherein a rotation direction of the second gear wheel, which is in the meshed position, around the second shaft based on the power from the third gear wheel becomes a direction that presses the first gear wheel to be meshed with the second gear wheel toward the inside of the mounting direction in the mounting portion.

5. The roll medium feeding apparatus according to claim 1, further comprising:

a holding member that is capable of holding the second wheel gear in the separated position.

6. A recording apparatus comprising:

l medium feeding apparatus according to claim 1; and a recording unit that performs a recording processing on the roll medium which is fed by the roll medium feeding apparatus.

* * * * *